US007708377B2

(12) United States Patent
Thayer et al.

(10) Patent No.: US 7,708,377 B2
(45) Date of Patent: May 4, 2010

(54) BLADE ENGAGEMENT APPARATUS FOR IMAGE FORMING MACHINES

(75) Inventors: Bruce E. Thayer, Webster, NY (US); Richard W. Seyfried, Williamson, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 12/201,230

(22) Filed: Aug. 29, 2008

(65) Prior Publication Data

US 2010/0053261 A1 Mar. 4, 2010

(51) Int. Cl.

| | |
|---|---|
| ***B41J 2/165*** | (2006.01) |
| ***G03G 21/00*** | (2006.01) |
| ***G03G 15/20*** | (2006.01) |
| ***G03G 15/08*** | (2006.01) |

(52) U.S. Cl. ..... 347/33; 347/28; 399/99; 399/326; 399/351; 399/284

(58) Field of Classification Search ..... 347/33, 347/29, 23, 32, 19, 28; 399/71, 99, 284, 399/326, 351

See application file for complete search history.

(56) References Cited

U.S. PATENT DOCUMENTS

| | | | | |
|---|---|---|---|---|
| 5,208,639 | A | 5/1993 | Thayer et al. | |
| 5,264,904 | A * | 11/1993 | Audi et al. | 399/71 |
| 5,432,539 | A * | 7/1995 | Anderson | 347/33 |
| 5,546,165 | A | 8/1996 | Rushing et al. | |
| 5,608,432 | A * | 3/1997 | Yamaguchi | 347/33 |
| 5,610,699 | A | 3/1997 | Yu et al. | |
| 5,778,296 | A | 7/1998 | van der Steen et al. | |
| 6,056,387 | A * | 5/2000 | Kaneko | 347/23 |
| 6,145,953 | A * | 11/2000 | Medin | 347/28 |
| 6,352,334 | B2 * | 3/2002 | Fukushima et al. | 347/33 |
| 6,438,329 | B1 | 8/2002 | Budnik et al. | |
| 6,648,449 | B2 * | 11/2003 | Gonzalez | 347/33 |
| 7,364,260 | B2 * | 4/2008 | Kojima | 347/33 |
| 2003/0232262 | A1 | 12/2003 | Yamada et al. | |
| 2006/0001911 | A1 | 1/2006 | Viassolo et al. | |
| 2006/0115285 | A1 | 6/2006 | Thayer | |
| 2007/0020005 | A1 | 1/2007 | Shigezaki et al. | |
| 2007/0139496 | A1 | 6/2007 | Leighton et al. | |
| 2007/0182800 | A1 | 8/2007 | Fioravanti et al. | |

* cited by examiner

*Primary Examiner*—Shih-Wen Hsieh
(74) *Attorney, Agent, or Firm*—Fay Sharpe LLP

(57) ABSTRACT

A blade engagement apparatus for metering release agent onto an image forming device associated moving surface, such as a Solid Ink Jet drum. The blade engagement apparatus includes a blade positioning mechanism having a blade holder rotated about a fixed pivot point disposed a distance $L_D$ from the moving surface. A plurality of metering blades extending from the blade holder each include a blade tip disposed a distance $L_B$ from the pivot point such that $L_B$ is greater than $L_D$. A replacement blade is brought into a working position in deflected engagement with the moving surface for metering a release agent onto the surface while the used blade is moved into a non-operational suspended position. Various blade replacement strategies are used to initiate a blade replacement operation.

20 Claims, 6 Drawing Sheets

BLADE ENGAGEMENT APPARATUS FOR IMAGE FORMING MACHINES

CROSS REFERENCE TO RELATED APPLICATIONS

Attention is directed to co-pending applications U.S. application Ser. No. 11/877,770 filed Oct. 24, 2007, entitled "LONG LIFE CLEANING SYSTEM WITH REPLACEMENT BLADES" and, U.S. application Ser. No. 12/201,140 filed concurrently herewith, entitled "SYSTEM AND METHOD OF ADJUSTING BLADE LOADS FOR BLADES ENGAGING IMAGE FORMING MACHINE MOVING SURFACES" the disclosure found in these co-pending applications is hereby incorporated herein by reference in its entirety.

BACKGROUND

Disclosed in embodiments herein are systems for metering and/or cleaning release agent on an image forming machine moving surface, and more specifically a release agent application apparatus utilizing a fixed rotating blade holder for moving blades between non-operational suspended positions and a common working position.

Image forming machines such as solid ink jet (SIJ) image forming machines generally use an electronic form of an image to distribute ink melted from a solid ink stick or pellet in a manner that reproduces the electronic image. In some solid ink jet imaging systems, the electronic image may be used to control the ejection of ink directly onto a media sheet. In other solid ink jet imaging systems, the electronic image is used to eject ink onto an intermediate imaging member. A media sheet is then brought into contact with the intermediate imaging member in a nip formed between the intermediate member and a transfer roller. The heat and pressure in the nip helps transfer the ink image from the intermediate imaging member to the media sheet.

One issue arising from the transfer of an ink image from an intermediate imaging member to a media sheet is the transfer of some ink to other machine components. For example, ink may be transferred from the intermediate imaging member to a transfer roller when a media sheet is not correctly registered with the image being transferred to the media sheet. The pressure and heat in the nip may cause a portion of the ink to adhere to the transfer roller, at least temporarily. The ink on the transfer roller may eventually adhere to the back side of a subsequent media sheet. If duplex printing operations are being performed, the quality of the image on the back side is degraded by the ink that is an artifact from a previous processed image.

To address these problems, various release agent applicators have been designed, often as part of an image drum maintenance system. These release agent applicators provide a coating of a release agent, such as silicone oil, onto the intermediate imaging member moving surface to reduce the undesired build-up of ink. It is desired to control the amount of release agent applied, since using of too much release agent causes undesirable streaks, also known as oil streaks, on the output prints.

The present application provides a new and improved apparatus for cleaning and/or metering a release agent onto an image forming device moving surface which overcomes these above-described problems.

DETAILED DESCRIPTION

Figure 1:
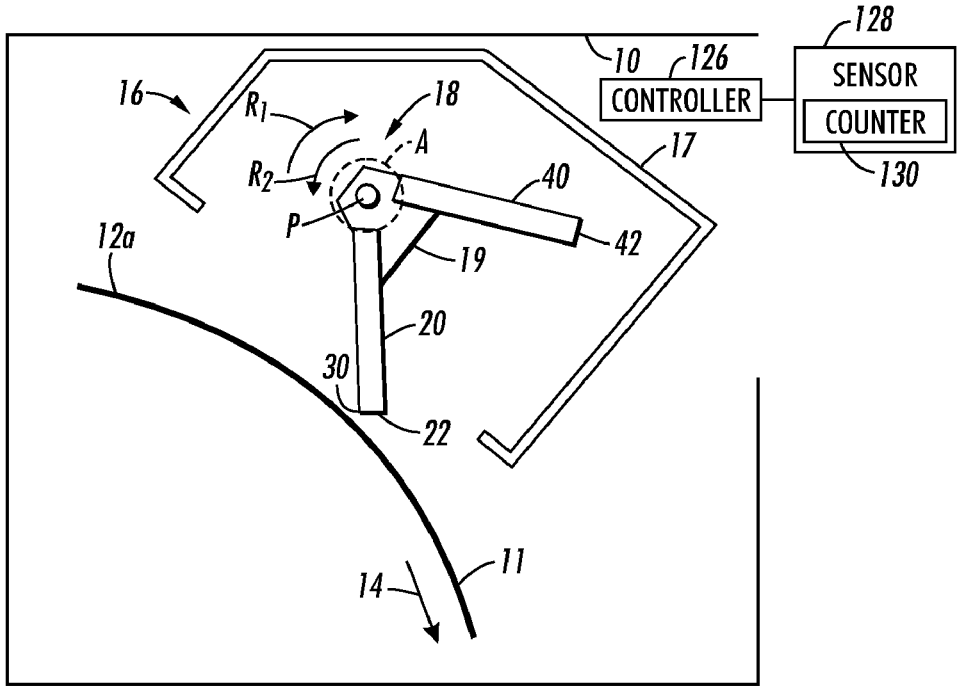
FIG. 1 illustrates a release agent application apparatus with an operational first blade disposed in retracted position as described herein.
Figure 2:
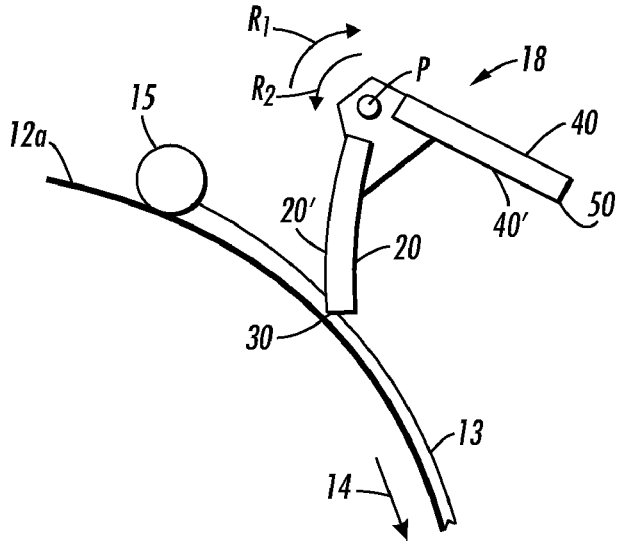
FIG. 2 illustrates release agent application apparatus with an operational first blade disposed in wiper blade orientation in a working position metering a release agent on a moving surface.
Figure 3:
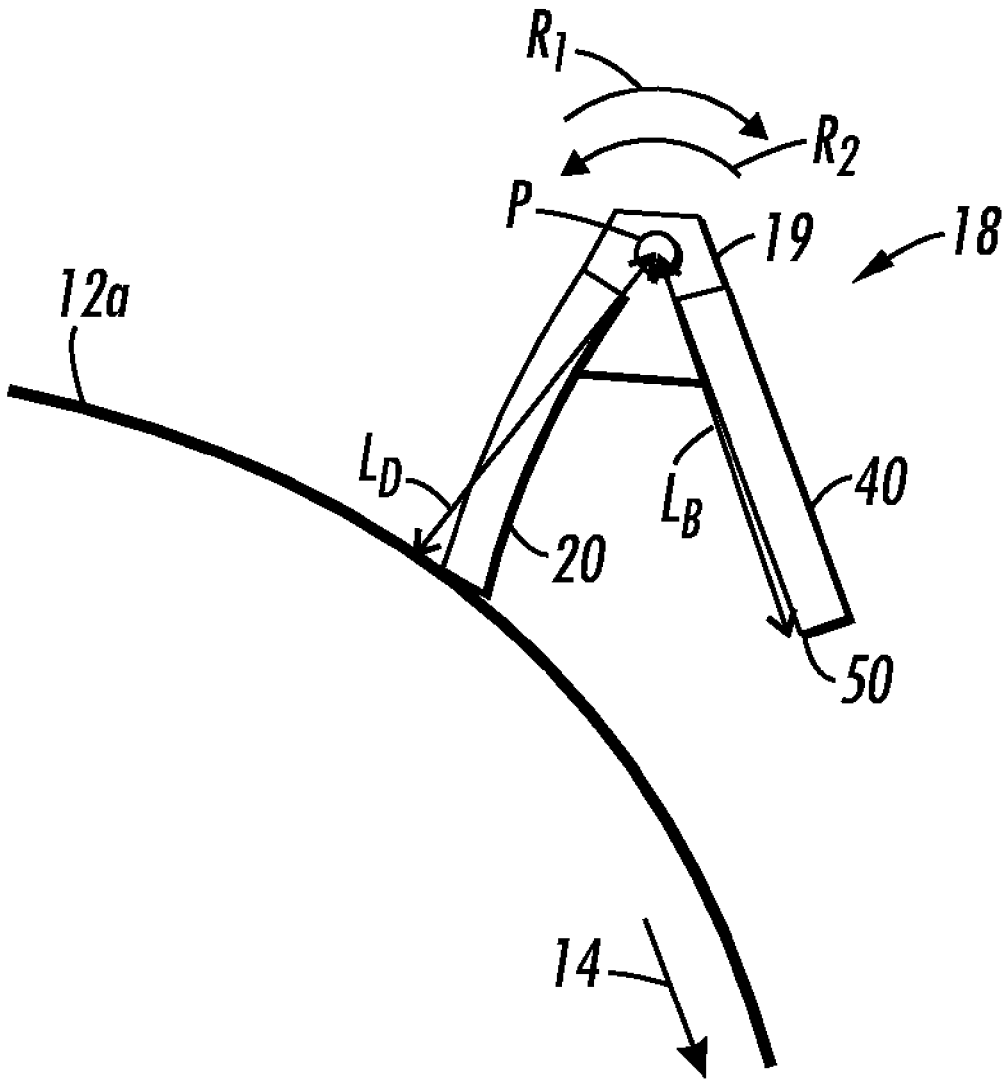
FIG. 3 illustrates a blade undergoing overbending during a replacement operation.

Referring now to FIGS. 1-3, an image forming machine, shown generally at 10, includes a moving surface 12 suitable for receiving a controlled application of a release agent. In one example, the image forming machine 10 is a Solid Ink Jet (SIJ) printer including a rotating SIJ drum 11 having a cylindrical outer surface 12*a* rotating in a rotational direction of operation 14. Other examples of applicable image forming machine moving surfaces 12 suitable for receiving application of a release agent can include flat moving surfaces 12*b* shown in FIGS. 4 and 5. These image forming machine moving surfaces 12*a*, 12*b* move in a direction of operation 14 and shall be referred to generally as moving surface 12.

The image forming machine 10 also includes a blade engagement apparatus, also referred to as a release agent application apparatus, shown generally at 16 for applying a controlled amount (thickness) of release agent 13 to surface 12 as shown in FIG. 2, in a process referred to herein as metering. The blade engagement apparatus 16 can be used for cleaning oil and other contaminants from the surface 12 in a cleaning operation, or both cleaning and metering.

The blade engagement apparatus 16 can be contained in a removable cartridge unit 17, if so desired, such as for example part of a maintenance unit, or drum maintenance unit (DMU). The maintenance unit 17 can be removed from the image forming machine 10 and discarded when its useful life has been depleted.

The blade engagement apparatus 16 includes a blade positioning mechanism 18 having a blade holder 19 with a plurality of blades extending therefrom. The blade positioning mechanism 18 rotates the blade holder 19 to move the blades into a working position engaging the surface 12 for metering the release agent 13 onto the surface, as described in further detail below. In the example provided herein, a pair of blades are used, including a first blade 20 and a second blade 40. However it should be appreciated that more than two blades can be used, as described in further detail below.

The blade holder 19 is rigid, and can be formed of aluminum, a composite, or other rigid material. It extends transversely across the surface 12 with respect to the operational direction of movement 14. It is adapted to be rotated about a pivot axis P. In one example, axis P can extend through the elongated holder 19, along its length. The holder 19 is supported at the pivot axis P by being pivotally connected to the DMU 17, or a support member attached to the image forming machine 10, such that the pivot axis P is disposed a fixed, distance $L_D$ from the surface 12, as shown in FIG. 3. The pivot axis P is fixed in that it does not translate as the blade holder 19 rotates about axis P. Distance $L_D$ is preferably the shortest distance between the pivot axis P and the moving surface 12, such as for example extending from the pivot axis P towards the center of a drum-shaped moving surface 12*a*, or at a right angle to a flat moving surface 12*b*.

Figure 4:
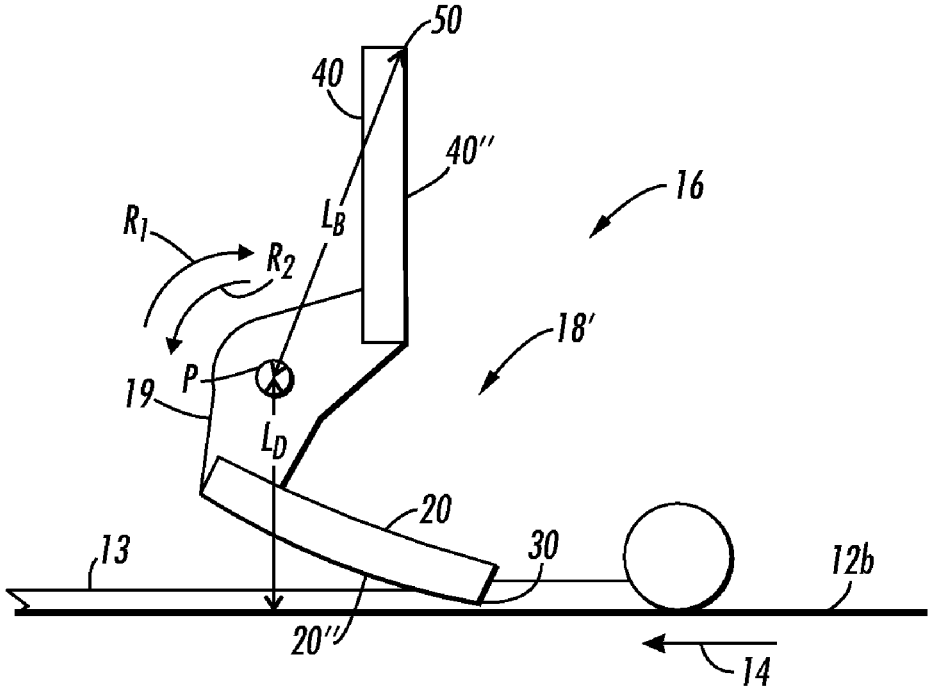
FIG. 4 illustrates a release agent application apparatus with an operational first blade disposed in doctor blade orientation in a working position metering a release agent on a moving surface.
Figure 5:
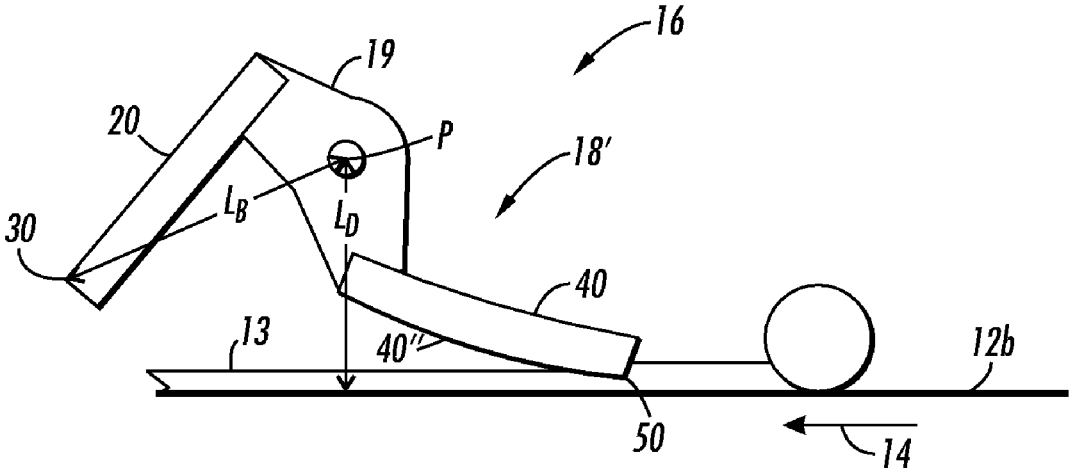
FIG. 5 illustrates a release agent application apparatus with an operational second blade disposed in doctor blade orientation in a working position metering a release agent on a moving surface.

The blades 20, 40 extend from the holder 19 and terminate in ends 22 and 42 respectively. The blades 20, 40 include respective blade edges, or tips, 30 and 50 disposed a distance $L_B$ from the pivot axis P, as shown in FIGS. 3 and 4. The blades 20, 40 extend transversely (with respect to the operational direction of movement 14) across the surface 12 such that the blade edges 30, 50 extend across the portion (or width) of surface 12 to which release agent is to be applied.

Distance $L_B$ is greater than distance $L_D$. The blades 20, 40 are formed of a compliant material, such as polyurethane, which bends, or deflects, as they are moved into the working position in which the blade tips 30, 50 are pressed against surface 12 generating a blade load at the tips against the surface, or material on the surface such as a release agent being metered. The interaction of the compliant blade 20, 40 in deflected engagement with the moving surface 12 in the working positions can be referred to generally as the blade interference. The blade interference can be considered a measure of how far the blade tip 30, 50 would extend into the surface 12 if the blade 20, 40 did not deflect. Moving the blade 20, 40 in a direction towards the surface 12, with the blade at the working position, increases the blade deflection and interference, thereby increasing the blade load at the blade tip 30, 50 against the surface 12 or material thereon. Whereas, moving the blade 20, 40 in a direction away from the surface 12, with the blade disposed in the working position, decreases the blade deflection and interference, thereby decreasing the blade load at the blade tip 30, 50. The tips 30, 50 can be coated with PMMA, SureLube, toner or other initial blade lubricant to prevent blade flip as the blades 20, 40 are moved into the working positions.

The blades 20, 40 extend from the holder 19 in an angularly-spaced apart manner, with the angle formed between the blades depending on the number of blades used. As mentioned, more than two blades can be attached to the blade holder 19, and each blade can be brought into a working position individually in a manner similar to that described below. The maximum number of blades that can be attached to the blade holder will be a function of the distance from the blade tip 30 to the blade holder pivot axis P, the desired blade holder angle between blades, and the diameter of the SIJ drum 12*a*, if applicable. The blade positioning mechanism 18 may be constrained by the space available within the image forming machine 10 and clearance of the blades to the surface 12 during retraction and engagement, however it is contemplated that two to five, or more, blades may be used.

The blade engagement apparatus 16 also includes an actuator A connected to the blade positioning mechanism 18 for providing bi-directional rotational movement to the blade holder 19. Actuator A is a connected to blade holder 19 to rotate the blade holder about axis P in a first direction $R_1$ and a second, opposite direction $R_2$. Actuator A can be a bi-directional stepper motor, a solenoid, a linear actuator, or other actuator connected to holder 19 in a suitable manner for applying rotational forces for rotating holder in the $R_1$ and $R_2$ directions. A pair of actuators A can be used, each connected to opposite ends of holder 19, for applying rotational forces thereto. The actuators A can be separately actuated, if so desired.

A controller, shown in FIG. 1, is used to provide control signals to the actuator A for rotating the holder in the $R_1$ and $R_2$ directions for moving the blades 20, 40 into and out of working positions with respect to the moving surface 12 as described in further detail below. While the blade 20 or 40 is in the working position, actuator A can rotate holder 19 to increase or decrease the blade interference, and thus the blade load, thereby increasing or decreasing the thickness of the release agent applied to surface 12, as described in further detail below, and as described in the co-pending application U.S. application Ser. No. 12/201,140 filed concurrently herewith, entitled "SYSTEM AND METHOD OF ADJUSTING BLADE LOADS FOR BLADES ENGAGING IMAGE FORMING MACHINE MOVING SURFACES" incorporated herein by reference in its entirety.

Sensors can be used to monitor for defects such as streaks on output prints or on moving surface 12 and the controller can signal actuator A to provide incremental bi-directional changes in rotation to holder 19 to make small changes in the blade load to achieve a minimum blade load needed for preventing these defects during image forming. By using two actuators A it is possible to vary the blade interference, and thus the blade load, differently at each end of the blade holder 19 to further adjust the blade load across the blade 20, 40 occupying the working position.

During operation, one of the blades, such as for example blade 20 in FIGS. 1-3, can be designated as the operational blade while the other blades can be considered to be non-operational blades, such as blade 40 in these FIGURES. The operational blade 20 can be the blade located closest to the surface 12. The operational blade 20 will typically be moved back and forth between a standby position in which the blade edge 30 is retracted, or suspended away from the surface 12, such as shown in FIG. 1, and a working position in which the blade edge 30 engages the surface 12 for metering the release agent onto the surface in a metering operation as shown in FIG. 2. Actuator A can move the operational blade 20 from the standby position to the working position by rotating the blade holder 19 in the first rotational direction $R_1$, and back to the standby position by rotating the blade holder in the second rotational direction $R_2$. This can occur repeatedly for any operational blade throughout its life of operation. The operational blade 20 occupies the standby position of FIG. 1 throughout much of the image forming process so as not to interfere with surface 12.

During a metering operation, a release agent 13, such as silicone oil or the like, is applied to surface 12 using an applicator 15 or in another known manner as shown in FIG. 2. The controller signals actuator A to rotate blade holder 19 in the first direction $R_1$ thereby moving the operational blade 20 in a direction towards the surface 12 and into the working position for metering the release agent onto the surface in a controlled thickness. The compliant blade 20 deflects as it is moved into the working position generating a blade load at the blade edge 30 against the surface, or against material on the surface such as the release agent 13 being metered.

As the first blade 20 engages the surface in the working position, a blade load is generated at the blade tip 30 against surface 12 for metering the release agent onto the surface. The blade load can be increased while the first blade 20 is in the working position by the actuator A rotating the blade holder 19 in the first direction $R_1$, thereby moving the blade 20 in a direction towards the surface 12, increasing the deflection and the interference of the compliant blade, thereby increasing the blade load at the tip 30 against the surface. Increasing the blade load meters a thinner layer of release agent 13 onto surface. While the first blade 20 is in the working position, in deflected engagement with the surface 12, the blade load at tip 30 can be decreased to meter a thicker layer of release agent by the actuator A rotating the blade holder in the second direction $R_2$.

The blade engagement mechanism 16 can include a blade positioning mechanism 18 having blades 20, 40 arranged in a wiper blade orientation when disposed in the working position, referred to herein as $WP_{WB}$, an example which is shown in FIG. 2. In $WP_{WB}$, the blade 20 (as it extends from the blade holder 19) forms an angle with surface 12 (or a tangent thereto)<90 degrees. This angle is taken at the blade tip 30 at the upstream side of the blade 20'(with respect to the moving surface operational direction 14), described in further detail in the co-pending application U.S. application Ser. No. 12/201,140 filed concurrently herewith, entitled "SYSTEM AND METHOD OF ADJUSTING BLADE LOADS FOR BLADES ENGAGING IMAGE FORMING MACHINE MOVING SURFACES" previously incorporated herein by reference in its entirety.

Figure 6:
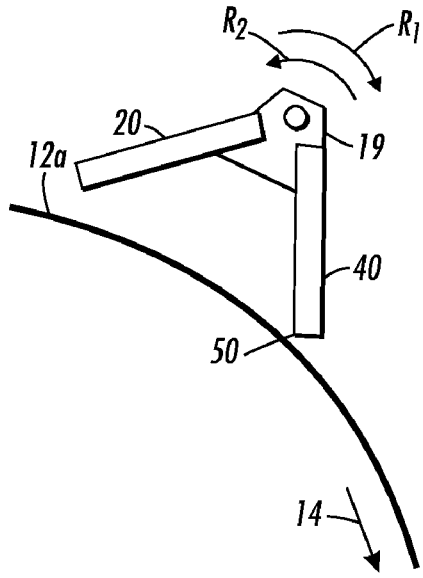
FIG. 6 illustrates a release agent application apparatus with an operational second blade disposed in retracted position as described herein.
Figure 7:
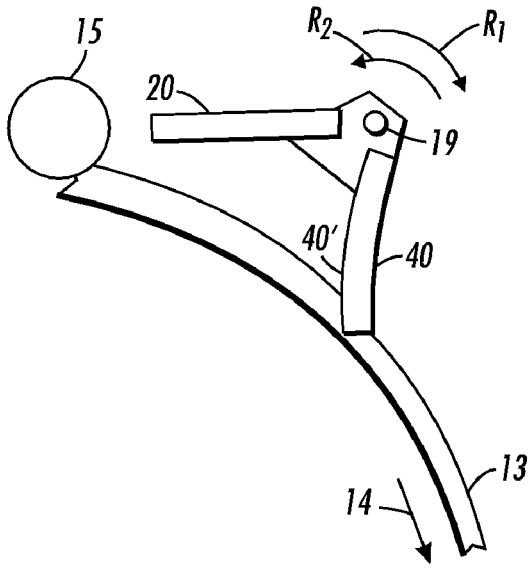
FIG. 7 illustrates a release agent application apparatus with an operational second blade disposed in wiper blade orientation in a working position metering a release agent on a moving surface.

Alternatively, the blade engagement mechanism 16 can include a blade positioning mechanism 18' having blades 20, 40 arranged in a doctor blade orientation when disposed in the working position, referred to herein as $WP_{DB}$, an example which is shown in FIGS. 6 and 7. The blade positioning mechanism 18' includes a blade holder 19 having blades 20 and 40 extending therefrom. Though two blades 20 and 40 have been shown for the purposes of simplicity, and it is contemplated that N blades can be used as described above. The blade positioning mechanism 18' operates in a manner similar to the blade positioning mechanism 18 described above, moving blades 20 and 40 into a working position $WP_{DB}$, wherein the blade 20, 40 (as it extends from the blade holder 19) forms an angle with surface 12 (or a tangent thereto)<90 degrees. The angle is taken at the blade tip 30, 50 at the downstream side of the blade 20", 40"(with respect to the moving surface operational direction 14), as described in further detail in the co-pending application U.S. application Ser. No. 12/201,140 filed concurrently herewith, entitled "SYSTEM AND METHOD OF ADJUSTING BLADE LOADS FOR BLADES ENGAGING IMAGE FORMING MACHINE MOVING SURFACES" previously incorporated herein by reference in its entirety. In some example embodiments, the doctor blade orientation has a BHA ranging from about 10 degrees to about 40 degrees. In other example embodiments, the doctor blade orientation has a BHA ranging from about 18 degrees to about 28 degrees.

Referring now to FIGS. 1, 3, 6 and 7, a blade replacement operation for the blade engagement apparatus 16 shall be described. At the end of the operational life of the first blade 20, the used blade is withdrawn from operation and the second blade 40 is placed into operation, as the operational blade, for movement into and out of the working position. The actuator A rotates the blade holder 19 in the first direction $R_1$ about the pivot axis P moving the first blade 20 towards the surface as shown in FIG. 1, and then across the surface 12 and past the working position creating a maximum amount of blade deflection (and blade interference), referred to as overbending, as shown in FIG. 3. Overbending is blade deflection, or blade interference, which is greater than amount of blade deflection, or blade interference, attained in the working position. The compliant blades 20, 40 are designed for overbending so that they do not break during blade replacement.

Rotation of the holder 19 is continued in first direction $R_1$ until the first blade 20 reaches a non-operational suspended position separated from the surface 12 as shown in FIG. 6. The first blade 20 can now be designated as a non-operational blade. In the non-operational position, the non-operational blade edge 30 can point away from the surface 12. The next blade, blade 40, is simultaneously brought into the operational standby, or retracted, position as shown in FIG. 6 and can now be designated as the operational blade. In the operational standby (retracted) position, the operational blade edge 50 can point towards the surface 12. The non-operational blade 20 is suspended a sufficient distance from surface 12 in the non-operational suspended position shown in FIG. 6, so as to not impede the flow of oil and contaminants from the operational blade 40 during use in the working position as shown in FIG. 7.

The operational, second blade 40 can be moved from the standby position, shown in FIG. 6, to the working position, shown in FIG. 7, by rotating the holder 19 in the first rotational direction R1. The operational second blade 40 can also be moved from the working position back to the standby position by rotating the holder in the second rotational direction R2. These actions can be repeated throughout the operational life of the second blade 40, as described above in reference to the first blade 20. Furthermore, the blade load at the second blade tip 50 can be increased and/or decreased for metering different thicknesses of release agent in a similar manner as described above in reference to the first blade 20.

It is contemplated that examples of the blade engagement apparatus 16 can include N blades, with some examples having N equal 4 or 5 blades, and some examples having N equal to more than 5 blades. The number of blades N can be a function of the distance from the blade tip to the blade holder pivot $L_B$, the desired blade holder angle, the diameter of the SIJ drum 12*a*, the space available within the image forming machine 10, and the clearance of the blades to the surface 12 during the retraction and engagement of the operational blade. In these embodiments, the other blades including the third blade to the $N^{th}$ blade can be brought into the operational standby position and the working position, in a similar manner as described above.

A number of strategies (e.g., blade replacement schedules) are possible for determining when to replace blades within the maintenance unit. For an individual blade, the blade can be replaced upon detection of a blade replacement condition, such as blade failure, a predetermined amount of use, etc. Blade failure can be detected by the machine operator or by a sensor 128 within the machine. For example, the sensor 128 can observe failures on output prints, or on the surface 12 as described in co-pending application U.S. application Ser. No. 12/201,140 filed concurrently herewith, entitled "SYSTEM AND METHOD OF ADJUSTING BLADE LOADS FOR BLADES ENGAGING IMAGE FORMING MACHINE MOVING SURFACES" previously incorporated herein by reference in its entirety.

Blade replacement strategy can comprise one or more replacement schemes based on blade use, run-to-failure schemes, and the like. For example, replacement strategies based on blade use can comprise analysis of cleaning unit failure probability at end of life specified (e.g., by a customer, by design constraints, etc.) Individual blades can additionally be replaced at intervals desired to achieve a specific cleaning unit failure probability.

Another replacement strategy for an N-blade system includes replacing the first N−1 blades based on use and replacing the Nth blade upon failure. In such a scenario, failure at end of cleaning unit life is deemed acceptable, cleaning unit failure probability for N−1 blades can be pre-specified, and individual blade replacement can be performed at predetermined intervals to achieve a desired N−1 blade failure probability.

In yet another replacement strategy, all blades are permitted to run to failure. According to one example, machine sensing of cleaning failures need not be employed, such as where failure of each individual blade is acceptable. In another example, cleaning failures are sensed by the machine. For instance, failures can be detected when they are minor print defects, on the SIJ drum before they appear on prints, etc.

Blades may also be replaced after a predetermined number of prints, drum cycles, or accumulation of stress. This strategy is desirable when life of the blade is sufficiently predictable. If blade life is not predictable (e.g., has a Weibull slope near 1), then a run-to-failure strategy may be employed. Blade replacement at a predetermined interval can be employed in scenarios where the time between replacements is sufficiently long and the probability of failure before that interval is sufficiently small. Typically, less than 5% to 10% of the blade population fail before the replacement interval, which is the time between blade changes. The required length of the replacement interval may be chosen to be compatible with other machine components and to enable a desired service or running cost for the machine. For example, if a cartridge containing a blade needs to have a B10 life of 400,000 cycles in order to meet run cost goals, then the blade may be required to have only 5% failures at 400,000 cycles. For a blade with a near-random failure distribution, a very large median blade life is required in order to meet such a target (e.g., a B5 of 400,000 cycles and a Weibull slope of 1 implies a characteristic life of 7,798,290 cycles and a B50 of 5,405,363 cycles). For a more symmetric failure distribution (e.g., near normal), the median blade life required to meet the target can be much smaller (e.g., a B5 of 400,000 cycles and a Weibull slope of 3 implies a characteristic life of 1,076,564 cycles and a B50 of 952,756 cycles).

Figure 8:
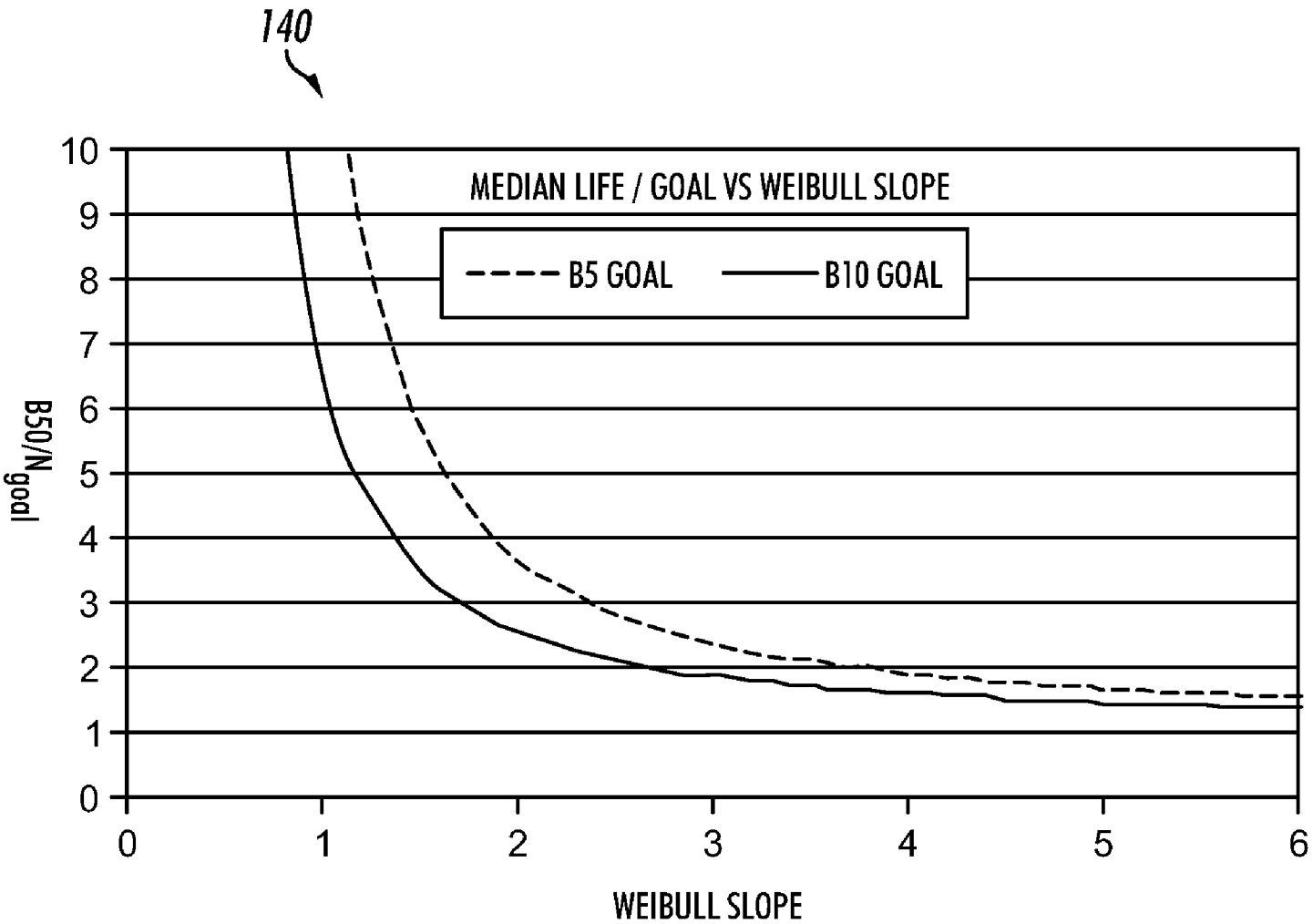
FIG. 8 shows a graph of the ratio of median blade life over the life goal as a function of Weibull slope.

FIG. 8 shows a graph 40 of the ratio of median blade life over the life goal as a function of Weibull slope. For Weibull slopes less than approximately 2 or 3, the desired median blade life to meet the goal is more than twice the goal. As the Weibull slope becomes smaller, it becomes increasingly difficult to achieve these very high median lives. Assuming a sufficiently predictable failure distribution, blades may be replaced after a predetermined number of prints.

Blade replacements based on accumulated stress can have more certainty in the amount of blade use than replacements based on SIJ cycle count, since blade stress is induced by the friction force between the blade and the SIJ drum. Higher friction forces, created by low lubrication conditions, generate higher stresses in the blade. The hardness, texture and coating of the SIJ drum surface also influence the blade-to-surface friction. Blade stress can be inferred by measuring the friction force on the metering blade. A measurement of the total friction force across the full width of the blade represents an average of the locally varying friction forces acting on the blade edge. Integration of the friction force over the number of SIJ drum cycles is equivalent to the energy applied to the blade edge, which can be correlated to wear of the blade edge and failure to meter.

Knowledge of cross-process variations in the friction force can be utilized to further reduce uncertainty in the accumulated stress contributing to metering failures. Local regions of the blade edge can be expected to wear at higher rates than other regions. With digital printing machines, this information is available from the location of exposed pixels on the imaging surface. Counters 130 can record accumulated blade stress for each region along the blade edge. The counters 130 can be interrogated to determine whether the most highly stressed region of the blade is approaching the accumulated stress level that triggers blade replacement. When this accumulated stress level has been reached, the blade can be replaced. The accumulated stress level that triggers replacement can be selected to correspond to a predetermined probability of blade failure (e.g., 5% of blades expected to reach failure prior to this level).

In a maintenance unit having replacement blades, the blades may be replaced by any combination of the above-described run-to-failure (RTF) and use strategies described above. Table 1, below, lists examples of combinations of replacement strategies that can be used for a two blade maintenance unit 17. Also listed are examples of lives expected from each blade and the combined maintenance unit life. In the presented examples, a blade with a run-to-failure replacement strategy is assumed to be replaced at the median (B50) life, although other points in the blade life cycle may be used. A blade replaced after a predetermined amount of use is assumed to be replaced at the B5 life (i.e., 5% blade population fails before this life), although other points (e.g., B10, B12, B15, etc.) may be used. Additionally, examples of probabilities of metering failures are listed. The first of the final two columns lists a probability of a metering failure before the maintenance unit has reached end of life (EOL), which is the probability of the first blade failing before EOL. The last column is the probability of a failure sometime during the life of the maintenance unit.

TABLE 1

Two blade maintenance unit life for all blade replacement strategy combinations.

| | Blade Replacement Strategies | | Expected Lives | | | Maintenance unit Failure Prob. | |
|---|---|---|---|---|---|---|---|
| | Blade 1 | Blade 2 | Blade 1 | Blade 2 | Maintenance unit | Before EOL | At EOL |
| 1 | Use | Use | B5 | B5 | 2 B5 | 5% | 9.75% |
| 2 | Use | RTF | B5 | B50 | B5 + B50 | 5% | 100% |
| 3 | RTF | Use | B50 | B5 | B5 + B50 | 100% | 100% |
| 4 | RTF | RTF | B50 | B50 | 2 B50 | 100% | 100% |

Example combination 1 in Table 1 has the shortest maintenance unit life of the exemplified combinations but the lowest probability of at least one metering failure. Example combination 4 has the longest maintenance unit life but has two metering failures. Running the first blade to failure and then stopping the second blade before failure typically yields little or no advantage; therefore, example combination 2 will typically be preferred to example combination 3. In a scenario where it is acceptable to end the life of the print cartridge with a metering blade failure, then the "before EOL" maintenance unit failure probabilities can be used for comparisons. In an example where, at end of life, the maintenance unit failure probability is desired to be 5%, then the blades in example combination 1 can to be replaced at the B2.5 life.

For a failure distribution with a predictable, sharp failure point (e.g., a high Weibull slope) example combination 1 may be an optimal choice. Although the maintenance unit life is short, the B5 and B50 lives are not significantly different. Trading off a small increase in maintenance unit life may be worth the large reduction in the probability of a metering failure. Such a replacement scheme can be desirable for customers who do not want to experience a single failures (e.g., the other three combination examples may have at least one failure). The remaining combination examples may be desirable for customers who are willing to trade off an occasional metering failure that is quickly remedied for much longer print cartridge life and lower run costs.

If the failure distribution is not predictable or sharp, then example combination 4 may be an optimal replacement scheme. For machines having replaceable blades with random failure modes, run-to-failure has been the traditional blade service strategy. For maintenance cartridge machines 10, such blades would only be used in very short-life cartridges. Because failure of the metering blade typically requires replacement of the entire print cartridge, it is desirable that blades have higher reliability in longer life cartridges.

Long print cartridge life can be achieved when maintenance units containing multiple blades are used, as described herein. For example, after running the first blade to failure, a controller can replace a failed blade that achieves the desired blade replacement. Additionally or alternatively, the operator can inform a machine controller of the failure and the machine controller can automatically replace the failed metering blade. In another example, the machine senses a metering failure before it is apparent to the operator, and then automatically replaces the failed blade. In higher speed and higher print volume machines, reliability and optimal duty cycle are high customer priorities and can be facilitated by the replacement schemes described herein.

Table 2 lists examples of replacement strategy combinations for a three-blade maintenance unit. The results for a three blade maintenance unit are similar to those for a two blade maintenance unit.

TABLE 2

Three blade maintenance unit life for all blade replacement strategy combinations.

| | Blade Replacement Strategies | | | Expected Lives | | | | Maintenance unit Failure Prob. | |
|---|---|---|---|---|---|---|---|---|---|
| | Blade 1 | Blade 2 | Blade 3 | Blade 1 | Blade 2 | Blade 3 | Maintenance unit | Before EOL | At EOL |
| 1 | Use | Use | Use | B5 | B5 | B5 | 3 B5 | 9.75% | 14.3% |
| 2 | Use | Use | RTF | B5 | B5 | B50 | 2 B5 + B50 | 9.75% | 100% |
| 3 | RTF | Use | Use | B50 | B5 | B5 | 2 B5 + B50 | 100% | 100% |
| 4 | Use | RTF | Use | B5 | B50 | B5 | 2 B5 + B50 | 100% | 100% |
| 5 | RTF | RTF | Use | B50 | B50 | B5 | B5 + 2 B50 | 100% | 100% |
| 6 | RTF | Use | RTF | B50 | B5 | B50 | B5 + 2 B50 | 100% | 100% |
| 7 | Use | RTF | RTF | B5 | B50 | B50 | B5 + 2 B50 | 100% | 100% |
| 8 | RTF | RTF | RTF | B50 | B50 | B50 | 3 B50 | 100% | 100% |

Table 3 lists the replacement strategy combinations for an N-blade maintenance unit, where N is an integer. Three examples of blade replacement strategies are shown.

TABLE 3

Multiple blade maintenance unit life for blade replacement strategies.

| | Blade Replacement Strategies | | Expected Lives | | | Maintenance unit Failure Prob. | |
|---|---|---|---|---|---|---|---|
| | Blades 1 to n − 1 | Blade n | Blades 1 to n − 1 | Blade n | Maintenance unit | Before EOL | At EOL |
| 1 | Use | Use | B5 | B5 | n B5 | $1 - (0.95)^{n-1}$ | $1 - (0.95)^{n}$ |
| 2 | Use | RTF | B5 | B50 | (n − 1) B5 + B50 | $1 - (0.95)^{n-1}$ | 100% |
| 3 | RTF | RTF | B50 | B50 | n B50 | 100% | 100% |

Table 4 lists the three examples of blade replacement strategies of Table 3, and the impact of failure sensing on whether or not these strategies will meet exemplary design requirement. For sensors that detect failures before they appear on prints, the run-to-failure replacement strategy enables long life, low run cost and no failures experienced by the customer.

TABLE 4

Blade replacement strategy and customer requirements.

| Blade Replacement Strategy | No Failure Sensing | Failure Sensing |
|---|---|---|
| All blades at B5 | Customer willing to trade long life and low run cost for few failures | Some benefit |
| First blades at B5 & last blade RTF | Failure acceptable on last blade | Some benefit |
| All blades RTF | Customer willing to trade failures for long life and low run cost | Acceptable to all customers - long life & low run cost without failures |

Figure 9:
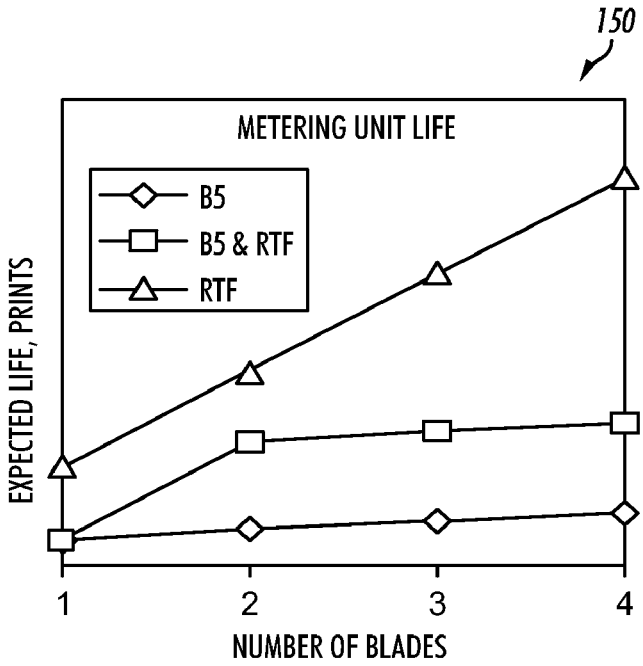
FIG. 9 is a graph of expected cleaning unit lives with various blade replacement strategies for a typical cleaning blade material.

FIG. 9 is a graph 150 of expected maintenance unit lives with various blade replacement strategies for a typical metering blade material. As can be seen, the run-to-failure strategy provides the longest life for respective blades, while the B5 strategy exhibits shorter blade life with improved duty cycle (e.g., blades are replaced before they fail, thereby reducing system down-time).

Figure 10:
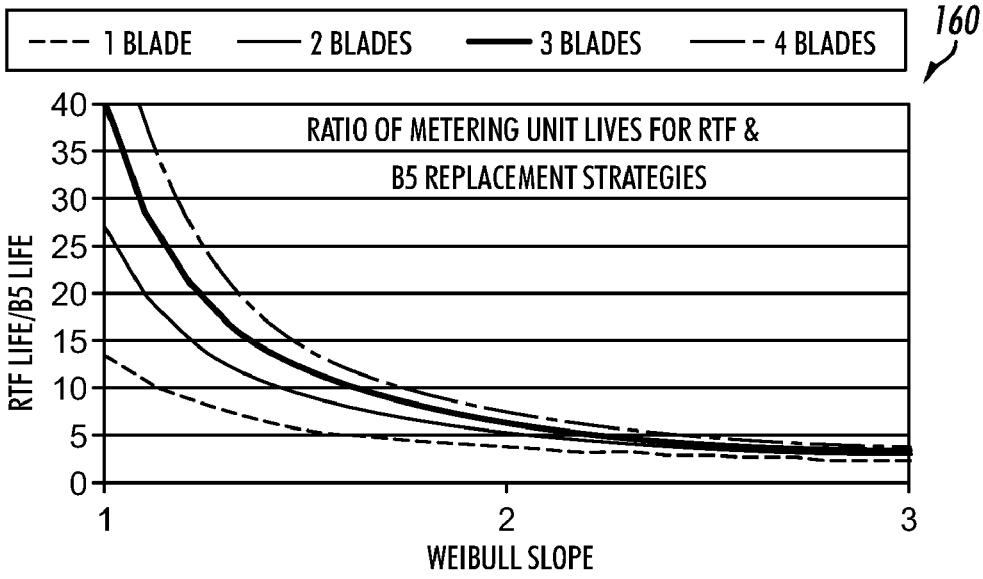
FIG. 10 is a graph illustrating the ratio of the run-to-failure replacement strategy life to the B5 replacement strategy life.

FIG. 10 is a graph 160 illustrating the ratio of the run-to-failure replacement strategy life to the B5 replacement strategy life. Relative to FIG. 9, the graph 60 represents the plotted triangles divided by the plotted diamonds. In FIG. 10, however, the ratio is shown as a function of the Weibull slope and the number of blades in the maintenance unit. As the Weibull slope increases, blade failure becomes more predictable with a sharper failure onset. As a result, the difference between run-to-failure and B5 replacement strategies becomes smaller for larger Weibull slopes. As the number of blades in the maintenance unit increases, the ratio of run-to-failure replacement lives over B5 replacement lives increases, albeit at a diminishing rate.

The blade engagement apparatus 16 provides a compact blade arrangement which can effectively extend the useful life of the release agent apparatus. It is configured to allow simplified replacement of blades 20, 40, etc. As the end of life of an operating blade is reached, the used blade is withdrawn from contact with the moving surface 12, placed into a suspended non-operational position, and another second blade is placed into operation. The life of the blade engagement apparatus 16 between service intervals required for replacement of used blades is therefore extended with high reliability.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A blade engagement apparatus providing blade engagement with an associated image forming machine having an associated moving surface comprising:

an elongated blade holder removably connected to the associated image forming machine having a pivot axis disposed a fixed distance from the associated moving surface;

a first elastomeric blade extending from the blade holder having a first blade tip extending transversely across the associated moving surface;

a second elastomeric blade extending from the blade holder angularly spaced apart from the first blade having a second blade tip extending transversely across the associated moving surface; and an actuator connected to the blade holder providing actuation forces rotating the blade holder in a first rotational direction about the pivot axis moving the first blade from a retracted standby position spaced apart from the associated moving surface wherein the first tip extends towards the associated moving surface to a deflected working position generating a blade load against the associated moving surface at the first tip to a suspended position spaced apart from the associated moving surface wherein the first tip extends away from the associated moving surface, the actuator providing actuation forces rotating the blade holder in a second rotational direction about the pivot axis opposite the first rotational direction moving the first blade from the working position to the retracted standby position.

2. The blade engagement apparatus of claim 1 further comprising:

the actuator connected to the blade holder providing actuation forces rotating the blade holder in the first rotational direction about the pivot axis moving the second blade from a retracted position spaced apart from the associated moving surface wherein the second tip extends towards the associated moving surface and the first blade is in the suspended position to a deflected working position generating a blade load against the associated moving surface at the second tip wherein the first blade is spaced apart from the associated moving surface to a suspended position spaced apart from the associated moving surface wherein the second tip extends away from the associated moving surface, the actuator providing actuation forces rotating the blade holder in a second rotational direction about the pivot axis opposite the first rotational direction moving the second blade from the working position to the retracted standby position.

3. The blade engagement apparatus of claim 1 further comprising:

the actuator providing actuation forces rotating the blade holder in the first rotational direction about the pivot axis with the first blade in the deflected working position for increasing the blade load against the associated moving surface at the first tip and the actuator providing actuation forces rotating the blade holder in a second rotational direction about the pivot axis opposite the first rotational direction with the first blade in the deflected working position for decreasing the blade load against the associated moving surface at the first tip.

4. The blade engagement apparatus of claim 1 further comprising:

the actuator providing actuation forces rotating the blade holder in a second rotational direction about the pivot axis opposite the first rotational direction with the first blade in the deflected working position for decreasing the blade load against the associated moving surface at the first tip.

5. The blade engagement apparatus of claim 1 further comprising:

the first blade tip and the second blade tip being disposed a distance $L_B$ from the pivot axis and the pivot axis being disposed a distance $L_D$ from the associated moving surface wherein $L_B > L_D$.

6. The blade engagement apparatus of claim 1, wherein the first and second blades are metering blades metering release agent onto the associated moving surface in the deflected working positions.

7. The blade engagement apparatus of claim 1 comprising a metering apparatus the first and second blades being metering blades metering the associated moving surface in the deflected working positions.

8. The blade engagement apparatus of claim 1 further comprising more than two blades extending from the blade holder each having a respective tip, the actuator rotating the blade holder about the pivot axis and moving each blade into a mutually exclusive deflected working position generating a blade load against the associated moving surface at the respective tip.

9. The blade engagement apparatus of claim 1 wherein the first and second blades are in Doctor Blade orientations in the deflected working positions.

10. The blade engagement apparatus of claim 1 wherein the first and second blades are in Wiper Blade orientations in the deflected working positions.

11. The blade engagement apparatus of claim 1 wherein the engagement apparatus is a replaceable cartridge.

12. The image forming machine of claim 11 wherein the moving surface is a solid ink jet drum.

13. The blade engagement apparatus of claim 1 further comprising the actuator providing actuation forces repeatedly moving the first elastomeric blade back and forth between the standby position and the working position throughout the operational life of the first blade.

14. An image forming machine comprising:

a moving surface; and a blade engagement apparatus comprising:

an elongated blade holder removably connected to the associated image forming machine having a pivot axis extending axially through the blade holder a fixed distance from the moving surface, a first elastomeric blade extending from the blade holder having a blade tip extending transversely across the moving surface, a second elastomeric blade extending from the blade holder angularly spaced apart from the first blade having a blade tip extending transversely across the moving surface, and an actuator connected to the blade holder providing actuation forces rotating the blade holder in a first rotational direction about the pivot axis moving the first blade from a retracted position spaced apart from the moving surface wherein the first tip extends towards the moving surface to a deflected working position generating a blade load against the moving surface at the first tip to a suspended position spaced apart from the moving surface wherein the first tip extends away from the moving surface, the actuator providing actuation forces rotating the blade holder in a second rotational direction about the pivot axis opposite the first rotational direction moving the first blade from the working position to the retracted standby position.

15. A method of replacing metering blades in an image forming machine maintenance unit, the image forming machine having a moving surface, comprising:

employing a predefined blade replacement schedule;

detecting a blade replacement condition in a maintenance unit coupled to an image forming machine moving surface; and rotating a blade holder about a pivot axis disposed a fixed distance from the moving surface to remove a used metering blade from metering contact with the image forming machine moving surface thereby ending the operational life of the used metering blade and to bring a replacement metering blade into a working position in operational contact with the moving surface metering a release agent onto the moving surface thereby starting the operational life of the replacement metering blade upon detection of the blade replacement condition.

16. The method of claim 15, further comprising replacing the used metering blade as a function of blade use, wherein the blade replacement condition is a function of a pre-specified end-of-life (EOL) failure probability for each blade.

17. The method of claim 15, further comprising replacing the used metering blade as a function of blade use, wherein the blade replacement condition is a function of a predetermined blade use interval that achieves a desired failure probability for the maintenance unit.

18. The method of claim 15, further comprising replacing N−1 used metering blades as a function of use and permitting an Nth blade to run to failure, where N is the number of blades in the cleaning unit.

19. The method of claim 18, further comprising pre-specifying a maintenance unit failure probability for the N−1 blades.

20. The method of claim 19, further comprising replacing individual metering blades at predetermined intervals to achieve a desired N−1 blade failure probability.

* * * * *